US009834408B2

(12) United States Patent
Fujiwara

(10) Patent No.: US 9,834,408 B2
(45) Date of Patent: Dec. 5, 2017

(54) ELEVATOR CALL REGISTERING SYSTEM

(71) Applicant: Mitsubishi Electric Corporation, Chiyoda-ku (JP)

(72) Inventor: Hideto Fujiwara, Chiyoda-ku (JP)

(73) Assignee: MITSUBISHI ELECTRIC CORPORATION, Chiyoda-ku (JP)

( * ) Notice: Subject to any disclaimer, the term of this patent is extended or adjusted under 35 U.S.C. 154(b) by 536 days.

(21) Appl. No.: 14/493,548

(22) Filed: Sep. 23, 2014

(65) Prior Publication Data

US 2015/0210505 A1 Jul. 30, 2015

(30) Foreign Application Priority Data

Jan. 28, 2014 (JP) ..... 2014-012912

(51) Int. Cl.
*B66B 1/28* (2006.01)
*B66B 1/46* (2006.01)

(52) U.S. Cl.
CPC ..... *B66B 1/468* (2013.01); *B66B 2201/4653* (2013.01); *B66B 2201/4676* (2013.01)

(58) Field of Classification Search
CPC ..... B66B 1/468; B66B 2201/4653; B66B 2201/4676
USPC .... 455/439, 440, 442, 443, 456.2; 340/10.1, 340/10.31, 10.4, 10.42, 10.51; 187/247, 187/391, 393, 380–388
See application file for complete search history.

(56) References Cited

U.S. PATENT DOCUMENTS 5,832,363 A * 11/1998 Moriya ..... B66B 1/34 187/391
5,952,626 A * 9/1999 Zaharia ..... B66B 1/468 187/381
5,984,051 A * 11/1999 Morgan ..... B66B 1/468 187/316
6,109,396 A * 8/2000 Sirag ..... B66B 1/468 187/381

(Continued)

FOREIGN PATENT DOCUMENTS

JP 2003-341945 12/2003
WO WO 2009/107206 A1 9/2009

*Primary Examiner* — Anthony Salata
(74) *Attorney, Agent, or Firm* — Oblon, McClelland, Maier & Neustadt, L.L.P.

(57) ABSTRACT

An elevator call registering system includes: a responder configure to store therein user identification information; an interrogator configured to broadcast interrogator identification information, an authentication control apparatus configured to compare the user identification information read out from the interrogator with stored user identification information, and an elevator control apparatus. The interrogator is configured to transmit group identification information, the responder is configured to store therein the group identification information received and to transmit the user identification information and the stored group identification information, and the interrogator configured to determine whether or not to transmit the destination floor information associated with the user identification information to the authentication control apparatus based on a comparison result of the group identification information received from the responder and the group identification information of the interrogator when the user identification information is read out from the uplink signal.

6 Claims, 14 Drawing Sheets

(56) References Cited

U.S. PATENT DOCUMENTS

| | | | | |
|---|---|---|---|---|
| 6,202,799 | B1 * | 3/2001 | Drop | B66B 1/468 187/384 |
| 6,397,976 | B1 * | 6/2002 | Hale | B66B 1/468 187/384 |
| 7,541,942 | B2 * | 6/2009 | Cargonja | G07C 9/00111 235/384 |
| 8,390,456 | B2 * | 3/2013 | Puleston | G06K 7/0008 340/10.1 |
| 8,525,652 | B2 * | 9/2013 | Takeuchi | B66B 1/468 187/247 |
| 8,626,198 | B2 * | 1/2014 | Das | H04W 4/028 455/440 |
| 8,960,373 | B2 * | 2/2015 | De Vincentis | B66B 1/2408 187/381 |
| 9,001,786 | B2 * | 4/2015 | Wang | H04W 36/385 370/331 |
| 2010/0315208 | A1 | 12/2010 | Takeuchi | |
| 2015/0151947 | A1 * | 6/2015 | Kuroda | B66B 1/468 187/380 |

* cited by examiner (CONT.)

ELEVATOR CALL REGISTERING SYSTEM

CROSS-REFERENCE TO RELATED APPLICATION

This application claims priority from Japanese Patent Application No. 2014-012912 filed on Jan. 28, 2014, the entire subject matter of which is incorporated herein by reference.

TECHNICAL FIELD

This disclosure relates to an elevator call registering system using a radio frequency identification (RFID).

BACKGROUND

In an elevator call registering system using an RFID of the background art, an LF (low frequency) signal is provided only with an antenna identification number for identifying each interrogator (for example, refer to WO2009/107206, paragraph [0006] and JP-A-2003-341945 paragraph [0014]).

SUMMARY

In the system using the RFID of the background art, the LF signal is provided with the antenna identification information. For example, when the antenna identification information received by a tag is the same, user identification information is not transmitted, and when the antenna identification information is different, the user identification information is transmitted. Thereby, when the tag detects moving between tag readers, the moving is notified to the system through a new tag reader. Also, when the tag is within a range of the same tag reader, the user identification information once transmitted is not again transmitted, so that the system is enabled not to perform useless processing.

However, when the system is applied to an elevator call registering system, following problems may be caused. For example, regarding a system where an RFID system is provided at an elevator landing and in an elevator car, a call is automatically registered when a user comes close to the elevator landing and a destination floor is automatically registered when the user gets in the elevator car, since different antenna numbers are provided for the elevator landing and the elevator car, the tag transmits an RF signal when the user gets off the elevator, in response to the LF signal at the elevator landing. As a result, even though the user gets off the elevator, the call is registered.

According to WO2009/107206, regarding the above problems, the registration of the registration identification information is held for grace time (for example, 5 seconds or longer and 10 seconds or shorter) after it is detected that the same identification information as the user identification information is not read by an interrogator in the elevator car. Thereby, when the user identification information of the elevator user is read by an interrogator provided at the elevator landing after getting off the elevator, the call registration of the elevator car is not performed. However, when the user gets off the overcrowding elevator car, the grace time elapses, so that the call is registered, which is a problem to be solved.

According to JP-A-2003-341945, regarding the above problems, a pri-call canceling unit for responding to the user identification information is provided. When the user identification information is not received from the tag (interrogator) before the elevator car determined as regards a destination call responds, the pri-call canceling unit cancel the destination call to turn off a landing button light of a direction corresponding to the destination call. However, the call is registered even though the user gets off the elevator still remains. Further, since the tag (responder) should always transmit the identification information, power consumption of the tag is increased.

In view of the above, an elevator call registering system of this disclosure includes: a responder configured to be carried by an elevator user and to store therein user identification information; an interrogator provided at an elevator landing of each floor, at a passage to the elevator landing and in an elevator car, respectively, and configured to broadcast interrogator identification information included in a downlink signal to the responder and to read out the user identification information from the responder; the responder being configured to compare the interrogator identification information received from the interrogator with stored interrogator identification information and to transmit the user identification information included in an uplink signal to the interrogator when a result of the comparison is not matched, an authentication control apparatus configured to compare the user identification information read out from the interrogator with stored user identification information and to transmit destination floor information of a user stored with being associated with the stored user identification information when a result of the comparison is matched, and an elevator control apparatus configured to allot an elevator car by using the destination floor information received from the authentication control apparatus. The interrogator is configured to transmit group identification information included in the downlink signal, which can be set for each group, the responder is configured to store therein the group identification information received from the interrogator and to transmit the user identification information and the stored group identification information to the interrogator included in the uplink signal based on a comparison result of the group identification information received from the interrogator and stored group identification information, and the interrogator further comprises a first determination unit configured to determine whether or not to transmit the destination floor information associated with the user identification information to the authentication control apparatus based on a comparison result of the group identification information received from the responder and the group identification information of the interrogator when the user identification information is read out from the uplink signal.

The elevator call registering system of this disclosure is configured as described above. Therefore, since the tag reader is configured to determine whether to transmit the returned user identification information to the authentication control apparatus for authentication, it is possible to prevent the problem that the call is registered even though the user gets off the elevator.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

First Illustrative Embodiment

Hereinafter, a first illustrative embodiment of this disclosure will be described with reference to FIGS. 1 to 5.

Figure 1:
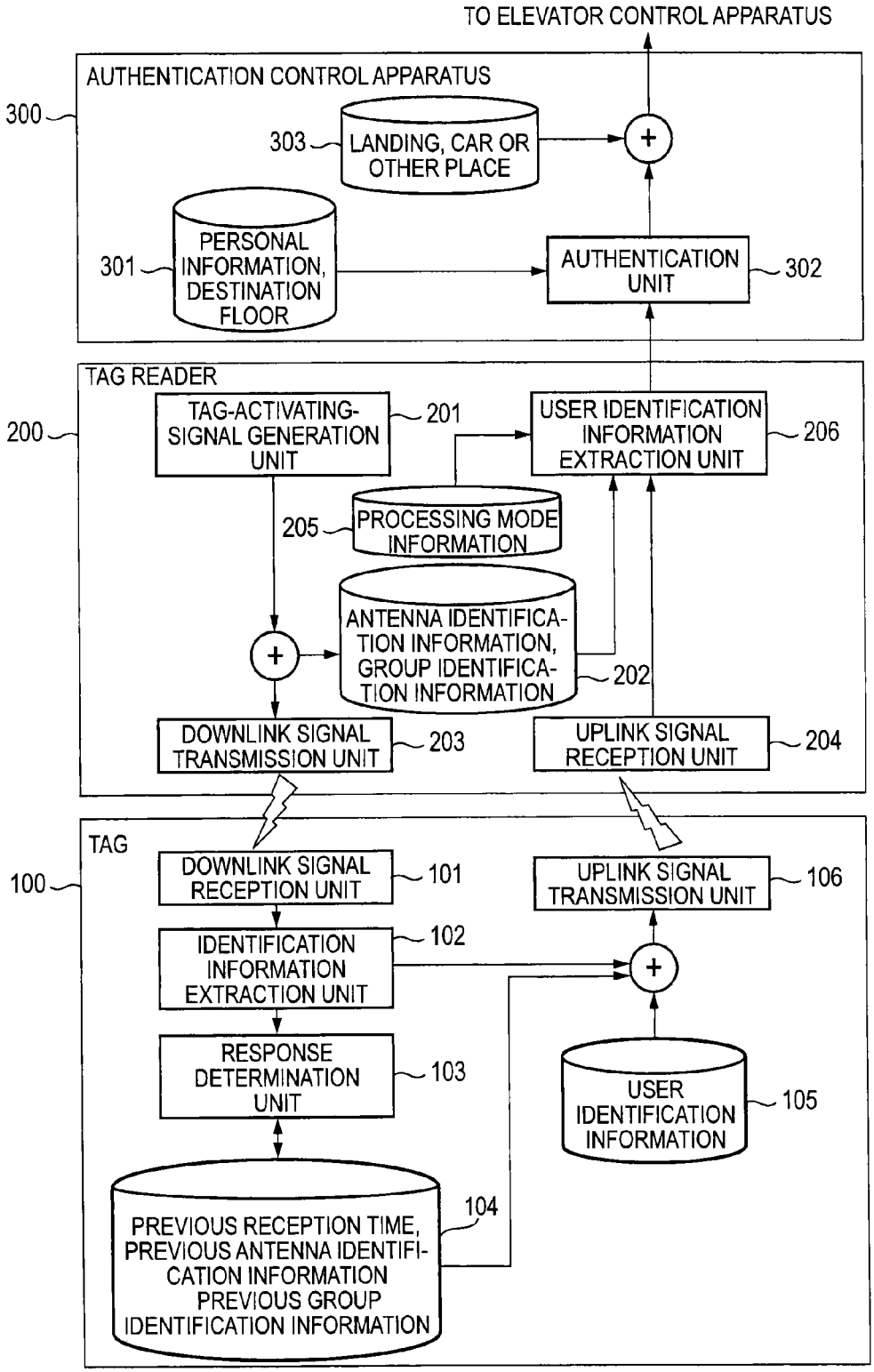
FIG. 1 is a configuration view of an elevator call registering system according to a first illustrative embodiment of this disclosure.

FIG. 1 is a configuration view of an elevator call registering system according to a first illustrative embodiment of this disclosure. In FIG. 1, a reference numeral 100 indicates a tag (responder). This is an RFID tag that is carried by a user, and may be incorporated and mounted in a mobile phone, a smart phone and the other apparatuses (hereinafter, simply referred to as 'tag'). The tag 100 is provided with a downlink signal reception unit 101 configured to receive a downlink signal from a tag reader (interrogator) 200 (which will be described later), an identification information extraction unit 102 configured to extract antenna identification information and group identification information from the downlink signal, a response determination unit 103 configured to determine whether to transmit user identification information to the tag reader 200 with an uplink signal, based on the antenna identification information, the group identification information, previous reception time, previous antenna identification information and previous group identification information, an uplink signal transmission unit 106 configured to transmit an uplink signal including the user identification information, the antenna identification information and the previous group identification information, a storage unit 104 configured to store therein the previous reception time, previous information for each antenna and the previous group identification information, and a storage unit 105 configured to store therein the user identification information. The downlink signal reception unit 101 includes a reception antenna circuit for receiving the downlink signal from the tag reader 200. The uplink signal transmission unit 106 includes a transmission antenna circuit for transmitting the uplink signal to the tag reader 200.

The reference numeral 200 indicates the tag reader (interrogator). The tag reader is provided at an elevator landing of each floor and a passage to the landing and in an elevator car. Any reader can be used inasmuch as it reads the user identification information from the tag 100 (hereinafter, simply referred to as 'tag reader'). The tag reader 200 is provided with a tag-activating-signal generation unit 201 configured to generate a tag activating signal for activating the tag 100, a downlink signal transmission unit 203 configured to provide the antenna identification information and group identification information read out from a storage unit 202 for the tag activating signal and to transmit the same as a downlink signal, an uplink signal reception unit 204 configured to receive the uplink signal from the tag 100, a user identification information extraction unit 206 configured to extract the user identification information included in the uplink signal, the storage unit 202 configured to store therein the antenna identification information and the group identification information, and a storage unit 205 configured to store therein processing mode information. The downlink signal transmission unit 203 includes a transmission antenna circuit for transmitting the downlink signal to the tag 100. The uplink signal reception unit 204 includes a reception antenna circuit for receiving the uplink signal from the tag 100.

A reference numeral 300 indicates an authentication control apparatus. The authentication control apparatus is provided with an authentication unit 302 configured to compare the user identification information transmitted from the tag reader 200 with stored personal information and to transmit a destination floor associated with the personal information to an elevator control apparatus when the information coincides with each other, and a storage unit 301 configured to associate and store therein the personal information and a destination floor.

Hereinafter, the operations are described.

Figure 2:
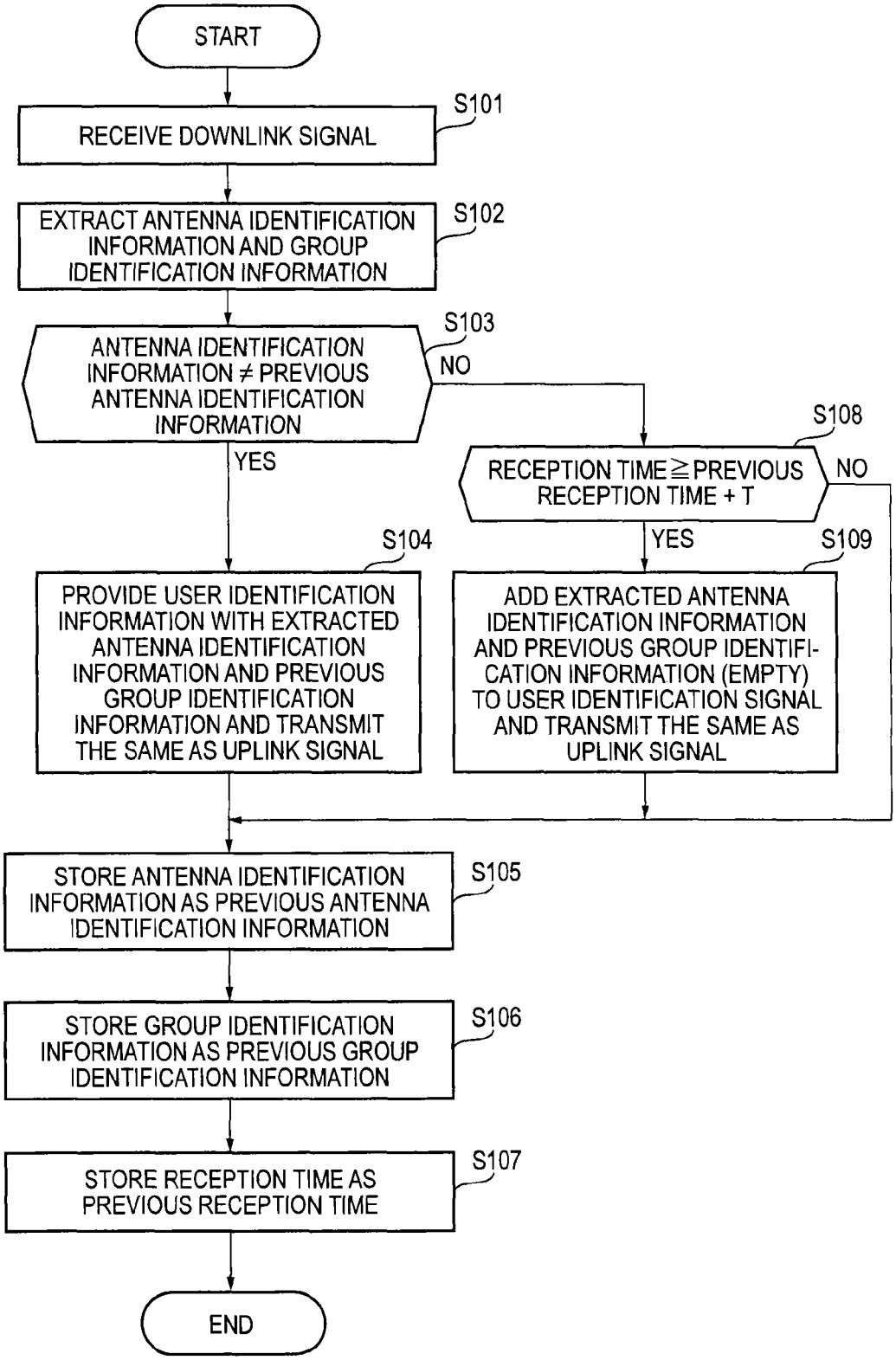
FIG. 2 is a flowchart showing operations of a tag 100 of the elevator call registering system according to the first illustrative embodiment of this disclosure.

FIG. 2 is a flowchart showing operations of the tag 100. When the downlink signal reception unit 101 receives a tag activating signal from the tag reader 200 (S101), the tag 100 extracts the antenna identification information and group identification information from the activating signal at the identification information extraction unit 102 (S102). The response determination unit 103 compares the extracted antenna identification information and the previous antenna identification information (the antenna identification information provided for the previous tag activating signal when the previous tag activating signal was received) stored in the storage unit 104 (S103). When the information does not coincide with each other, the response determination unit 103 determines that the activating signal is received from a tag reader different from the previous tag reader, reads out the user identification information from the storage unit 105 so as to transmit the user identification information to the tag reader 200, provides the read user identification information with the interrogator identification information extracted in S102 and the previous group identification information (the group information provided for the previous tag activating signal when the previous tag activating signal was received) read out from the storage unit 104, and transmits the uplink signal from the uplink signal transmission unit 106 (S104). Thereafter, the tag 100 rewrites the previous antenna identification information and previous group identification information in the storage unit 104 with the antenna identification information and group identification information of the activating signal received this time (S105, S106). At the same time, the tag 100 rewrites the previous reception time (time at which the previous tag activating signal was received) with this time reception time (S107).

On the other hand, when it is determined in S103 that the antenna identification information and the previous antenna identification information coincide with each other, the tag receives the activating signal from the same tag reader 200 as the previous tag reader and transmits the user identification information to the tag reader 200. Therefore, although it is not basically necessary to again transmit the user identification information, when the tag once deviates from a signal range of the tag reader 200 and again returns to the signal range of the tag reader 200 after predetermined time elapses, it is necessary to again transmit the user identification information for authentication. Hence, the response determination unit 103 compares the reception time of the tag activating signal and the previous reception time stored in the storage unit 104 and determines that the tag once deviates from the signal range of the tag reader 200 and again returns to the signal range, when predetermined time T or longer elapses (S108), thereby preceding to S109. In S109, the tag reads out the user identification information from the storage unit 105 so as to transmit the user identification information to the tag reader 200, provides the read user identification information with the antenna identification information extracted in S102 and empty information or special identification information, as the previous group identification information, which is prohibited from being allotted to the tag reader 200, and transmits the uplink signal from the uplink signal transmission unit 106. The reason is as follows. Considering the elevator landing, the tag holder comes close to the elevator, so that the tag 100 is authenticated at the landing. However, if the tag holder leaves the landing without getting in the elevator and again returns thereto, the tag holder cannot get in the elevator without authentication. In particular, the reason to transmit the other identification information, not the previous group identification information originally stored, as the previous group identification information, is as follows: when the processing mode information is β in operations of the tag reader 200 that will be described later, the group identification information and the previous group identification information of the tag reader 200 are determined to be the same, so that the user identification information is ignored and the tag is not thus authenticated.

Figure 3:
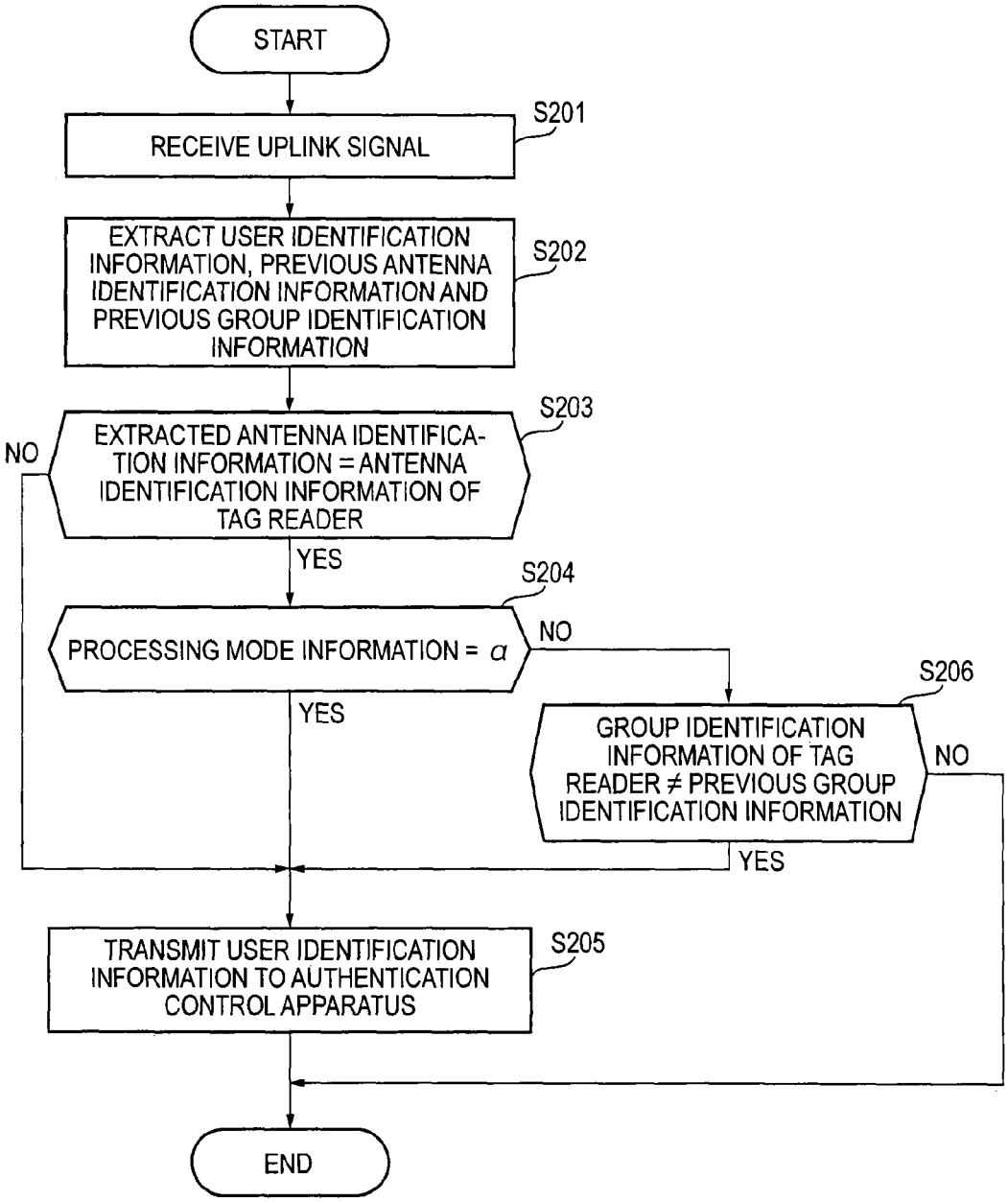
FIG. 3 is a flowchart showing operations of a tag reader 200 of the elevator call registering system according to the first illustrative embodiment of this disclosure.

FIG. 3 is a flowchart showing operations of the tag reader 200. Although not shown in the flowchart, the tag reader 200 always generates the tag activating signal at the tag-activating-signal generation unit 201 at a predetermined interval, provides the generated tag activating signal with the antenna identification information, which is a number inherent to each tag reader and is stored in the storage unit 202, and the group identification information for identifying some tag readers as one group, and transmits the downlink signal from the downlink signal transmission unit 203. For example, in the group identification information, the interrogator provided at each elevator landing and the interrogator provided in the elevator car are grouped as the same group, and the interrogator provided at each passage is grouped as other groups different from the first group of the elevator landing and the elevator car.

When the uplink signal from the tag 100 is received at the uplink signal reception unit 204 (S201), the user identification information extraction unit 206 extracts the user identification information, the antenna identification information and the previous group identification information from the received uplink signal (S202). Further, the tag reader compares the antenna identification information thereof stored in the storage unit 202 and the extracted antenna identification information. When the information coincides with each other, the tag reader determines that the tag 100 transmits the user identification information, in response to the tag activating signal transmitted by the tag reader, and executes following processing. In S203, the tag reader changes the processing mode information stored in the storage unit 205 by call processing mode information. Here, the processing mode information α is a mode instructing the tag reader to unconditionally transmit the user identification information to the authentication control apparatus 300. The processing mode information β is a mode instructing the tag reader to determine whether or not to transmit the user identification information to the authentication control apparatus 300 based on the extracted previous group identification information. When the processing mode information is α in S203, the tag reader proceeds to S204 and unconditionally transmits the user identification information to the authentication control apparatus 300. On the other hand, when the processing mode information is β, the tag reader proceeds to S205, compares the previous group identification information extracted in S202 and the group identification information of the tag reader. When the information does not coincide with each other, the tag reader transmits the user identification information to the authentication control apparatus 300. However, when the information coincides with each other, the tag reader does not transmit the user identification information to the authentication control apparatus 300. This means that if the processing mode information is β, when the holder of the tag 100 goes about the signal ranges of the plurality of tag readers 200 having the same group identification information, the tag is authenticated in the first tag reader 200 but is not authenticated in the subsequent tag readers 200.

The authentication control apparatus 300 is provided with the storage unit 301. In the storage unit 301, the user identification information of a plurality of persons to be authenticated is beforehand registered with being associated with a destination floor (for example, a floor at which an office is located) to which each person can go. When the user identification information is received from the tag reader 200, the authentication unit 302 searches the matched user identification information from the plurality of user identification information stored in the storage unit 301. When the matched user identification information is searched, the authentication control apparatus transmits the destination floor information associated with the matched user identification information to the elevator control apparatus, together with information capable of identifying whether the tag reader 200 is provided at the elevator landing, in the elevator car or at the other place.

Although the elevator control apparatus is not shown, when the destination floor information is received, the elevator control apparatus determines an upward or downward button provided at the elevator landing based on a relation between a current floor and the transmitted destination floor information, if the destination floor information is transmitted from the tag reader 200 provided at the elevator landing, and registers any one button (this is a state where the upward or downward button is pressed by a person).

When the destination floor information is transmitted from a tag reader 200*a* provided in the elevator car, the elevator control apparatus registers the transmitted destination floor (this is a state where a destination floor button is pressed by a person). When the destination floor information is transmitted from the other tag reader 200*c*, the elevator control apparatus ignores the destination floor information.

Figure 4:
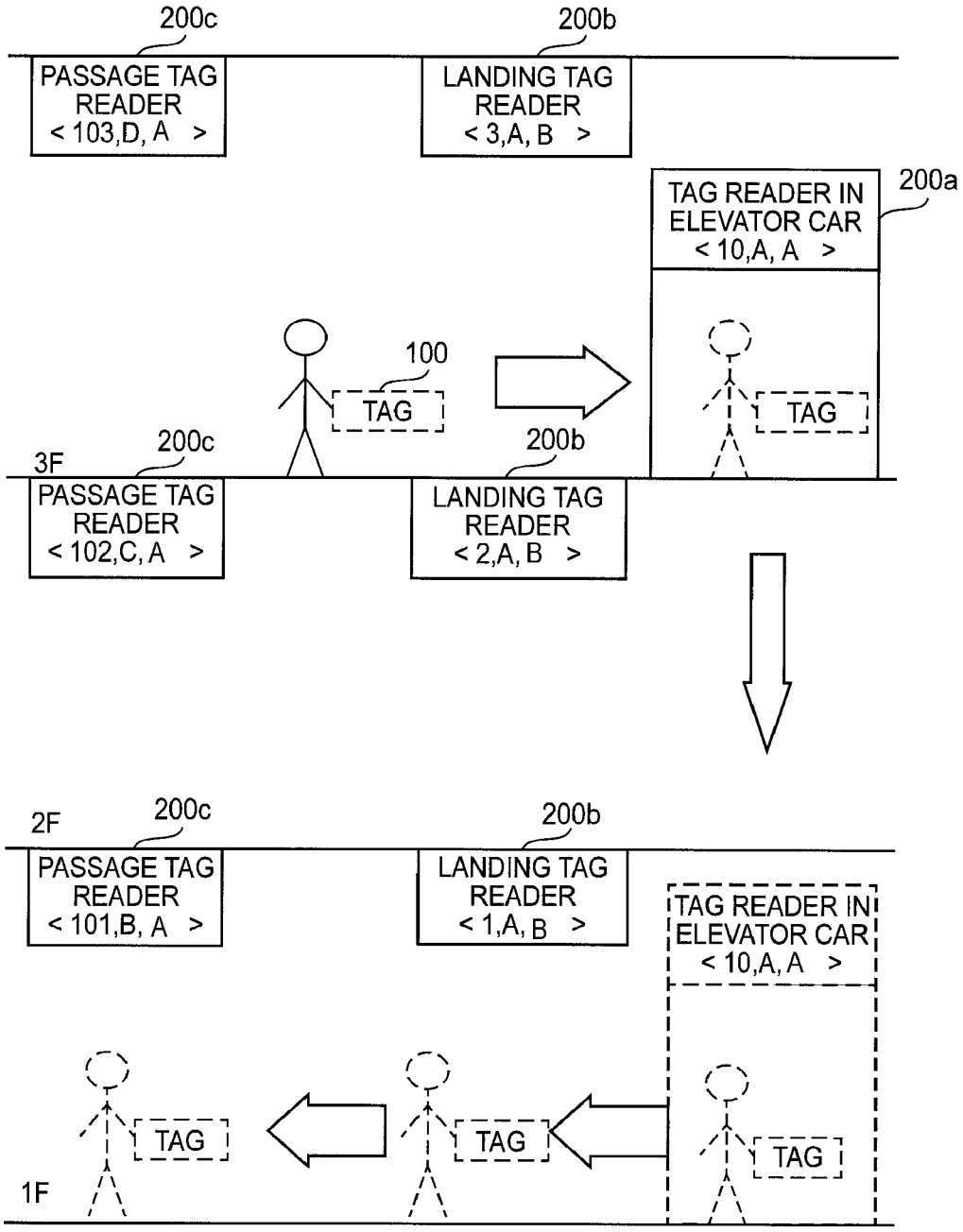
FIG. 4 is a configuration view where the elevator call registering system according to the first illustrative embodiment of this disclosure is applied to a building.
Figure 5:
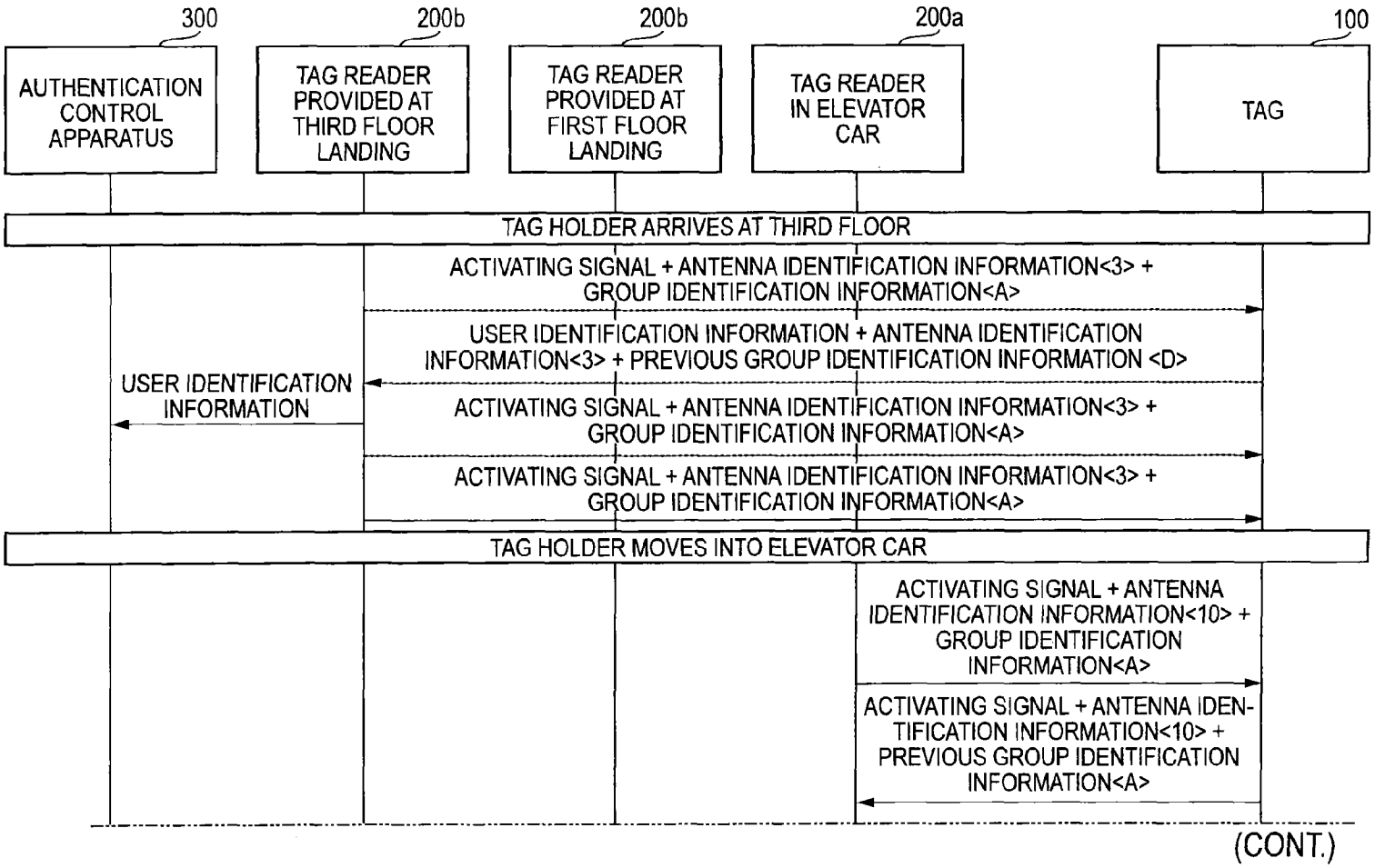
FIG. 5 is a flowchart showing respective identification information between respective apparatuses in the first illustrative embodiment of this disclosure.
Figure 5:
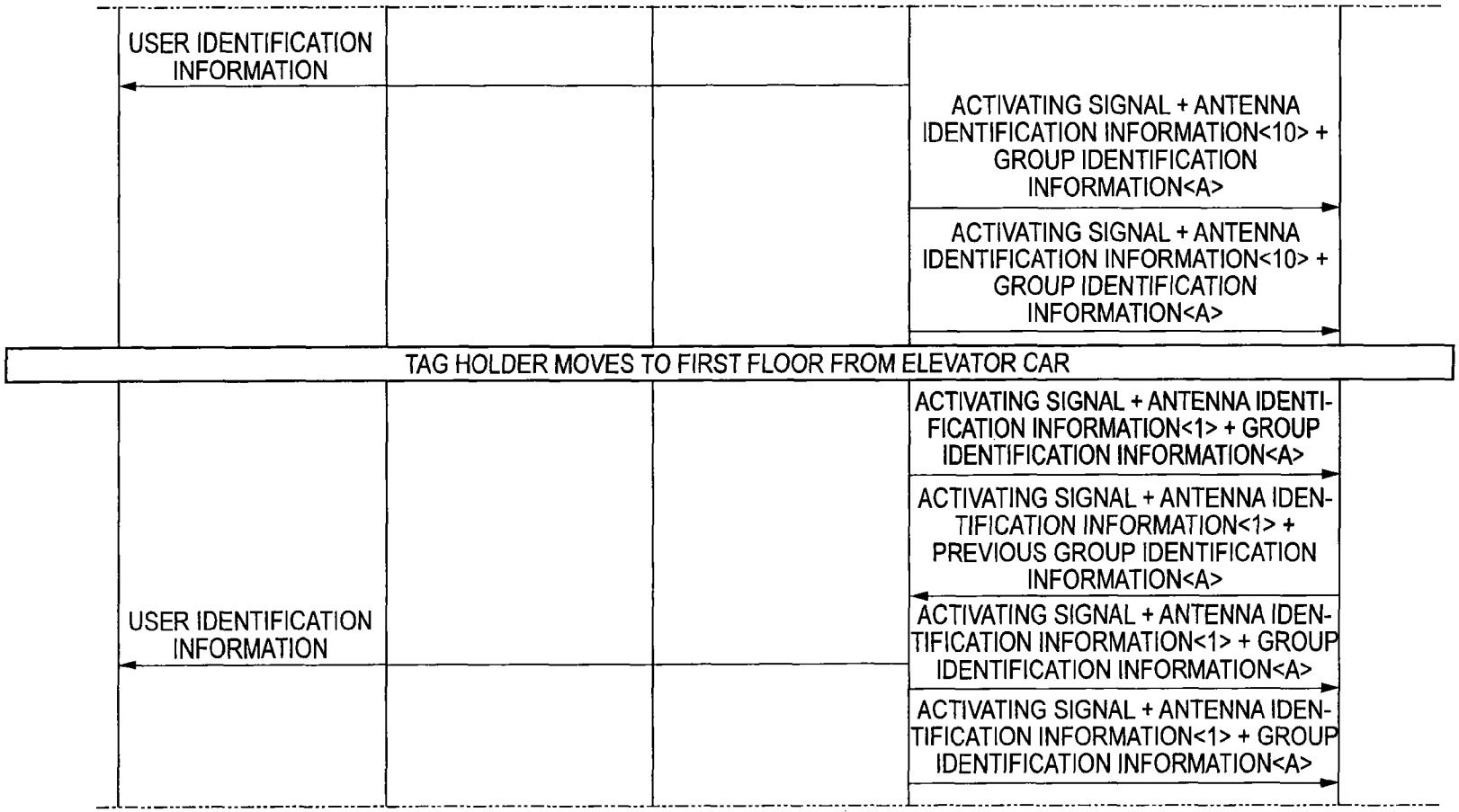
Figure 5:
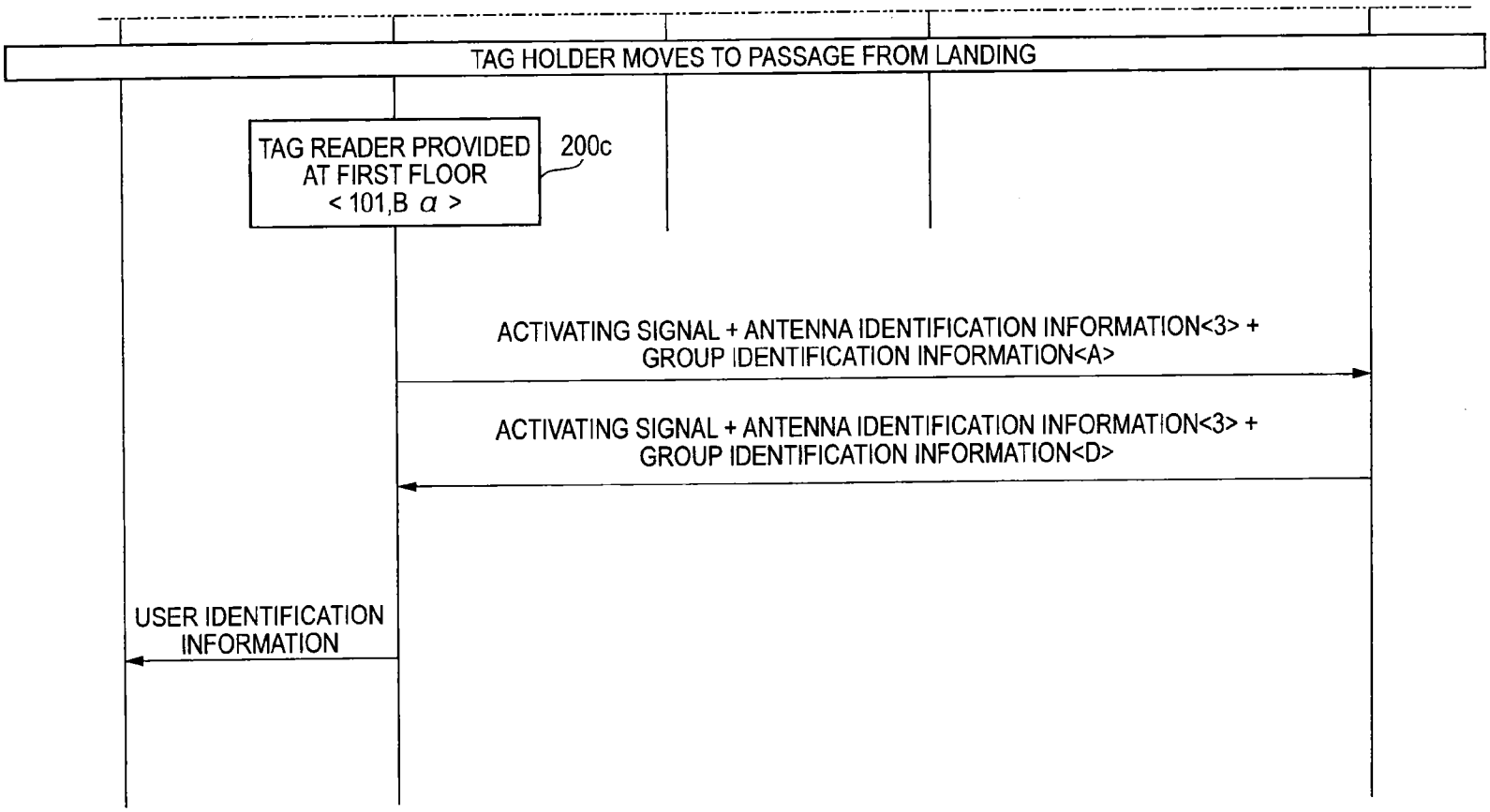

The above operations are described in association with moving with reference to FIGS. 4 and 5.

A case is described in which a tag holder passes to a third floor passage, arrives at the elevator landing, gets in the elevator to move to a first floor, gets out the elevator and passes to a first floor passage. It is assumed that the tag holder has beforehand registered the first floor, as the destination floor, in the authentication control apparatus 300.

In FIG. 4, for example, the description <103, D, α> indicates that 103 is set as the antenna identification information, D is set as the group identification information and α is set as the processing mode information in the tag reader 200.

First, the tag holder is authenticated at a stage where the tag holder enters the signal range of the tag reader 200*c* provided at the third floor passage. However, the elevator control apparatus ignores the destination floor information associated with the tag holder (which is not shown in FIG. 5). At a stage where the tag holder moves into the signal range of the tag reader 200*b* provided at the third floor landing, since the tag 100 is different from the previous antenna identification information (the antenna identification information 103 of the tag reader 200*c* provided at the third floor passage) storing as the tag 100, the tag 100 transmits the user identification information to the tag reader 200*b*. Although the tag reader 200*b* has the processing mode information β, since the group identification information of the tag reader 200*b* is different from the previous group identification number (D of the tag reader 200*c* provided at the third floor passage) transmitted together with the user identification information, the tag reader 200*b* transmits the user identification information to the authentication control apparatus 300. When the authentication is successful, the authentication control apparatus 300 transmits the destination floor information (first floor) to the elevator control apparatus. As a result, since the current floor is the third floor and the destination floor information is the first floor, the elevator control apparatus registers the downward button. Therefore, even when the tag holder does not push the downward button, the elevator is automatically called. Until the elevator arrives, the tag 100 waits within the signal range of the tag reader 200*b* provided at the third floor landing and periodically receives the activating signal. However, since tag 100 has once transmitted the user identification information to the tag reader 200*b*, the tag 100 does not again transmit the user identification information as long as the tag stays within the signal range.

Then, when the tag holder gets in the elevator having arrived and enters the signal range of the car tag reader 200*a*, since the tag 100 is different from the previous antenna identification information (the antenna identification information 3 of the tag reader 200*b* provided at the third floor landing) storing as the tag 100, the tag 100 transmits the user identification information to the tag reader 200*a*. Since the tag reader 200*a* has the processing mode information α, it unconditionally transmits the user identification information to the authentication control apparatus 300. When the authentication is successful, the authentication control apparatus 300 transmits the destination floor information (first floor) to the elevator control apparatus. As a result, since the elevator control apparatus automatically registers the first floor button, the tag holder does not have to push the first floor button. When the elevator car arrives at the first floor and the tag holder gets off the elevator car and moves into the signal range of the tag reader 200*b* provided at the first floor landing, since the tag 100 is different from the previous antenna identification information (the antenna identification information 10 of the car tag reader 200*a*) storing as the tag 100, the tag 100 transmits the user identification information to the tag reader 200*b*. Since the tag reader 200*b* has the processing mode information β, it compares the group identification information of the tag reader 200*b* with the previous group identification number (A of the car tag reader 200*a*) transmitted together with the user identification information and does not transmit the user identification information to the authentication control apparatus 300 because the information coincides with each other. As a result, since the authentication is not made when the tag holder moves from the elevator car to the tag reader 200*b* provided at the landing, the upward or downward button provided at the first floor landing is not registered.

Thereafter, when the tag holder moves into the signal range of the tag reader 200*c* provided at the first floor passage, since the tag 100 is different from the previous antenna identification information, it transmits the user identification information. Since the tag reader 200*c* has the processing mode information α, it unconditionally transmits the user identification information to the authentication control apparatus 300. The authentication control apparatus 300 authenticates the user identification information at the authentication unit 302 and transmits the destination floor information to the elevator control apparatus. However, since the corresponding information is the information from the tag reader 200*c*, which is not provided at the elevator landing and in the elevator car, the elevator control apparatus ignores the information. Therefore, the elevator system does not work.

As described above, according to the illustrative embodiment, the tag reader transmits the returned user identification information to the authentication control apparatus to determine whether or not to authenticate the same. Therefore, when the tag holder arrives at the landing from the passage, the upward or downward button is automatically registered. Also, when the tag holder gets in the elevator car, the destination floor is automatically registered. However, when the tag holder gets off the elevator car and arrives at the landing, the unnecessary upward or downward button is not registered. Therefore, it is possible to prevent the problem that even when the user gets off the elevator, the call is registered.

In the above illustrative embodiment, the storage unit 104 and the storage unit 105 are separately provided. However, the same storage unit may be used with only the storage areas being separately provided. The storage unit 202 and the storage unit 205 and the storage unit 301 and the storage unit 303 are also the same.

Also, although the car tag reader 200*a*, the landing tag reader 200*b* and the passage tag reader 200*c* are described as separate configurations, they can be implemented with the same hardware inasmuch as they are configured to download the antenna identification information and group identification information of the storage unit 202 and the processing mode information of the storage unit 205 from the outside.

Further, the antenna identification information, the group identification information and the processing mode information of the above illustrative embodiment are just exemplary and can be variously changed or reused without departing from the scope of this disclosure.

In addition, even when the parts of the configuration may be modified or omitted, the same effects as the illustrative embodiment can be realized.

Second Illustrative Embodiment

In the first illustrative embodiment, the tag reader 200 determines whether or not to transmit the user identification information received from the tag 100 to the authentication control apparatus 300. In this illustrative embodiment, the tag 100 determines whether or not to transmit the user identification information to the authentication control apparatus 300.

Figure 6:
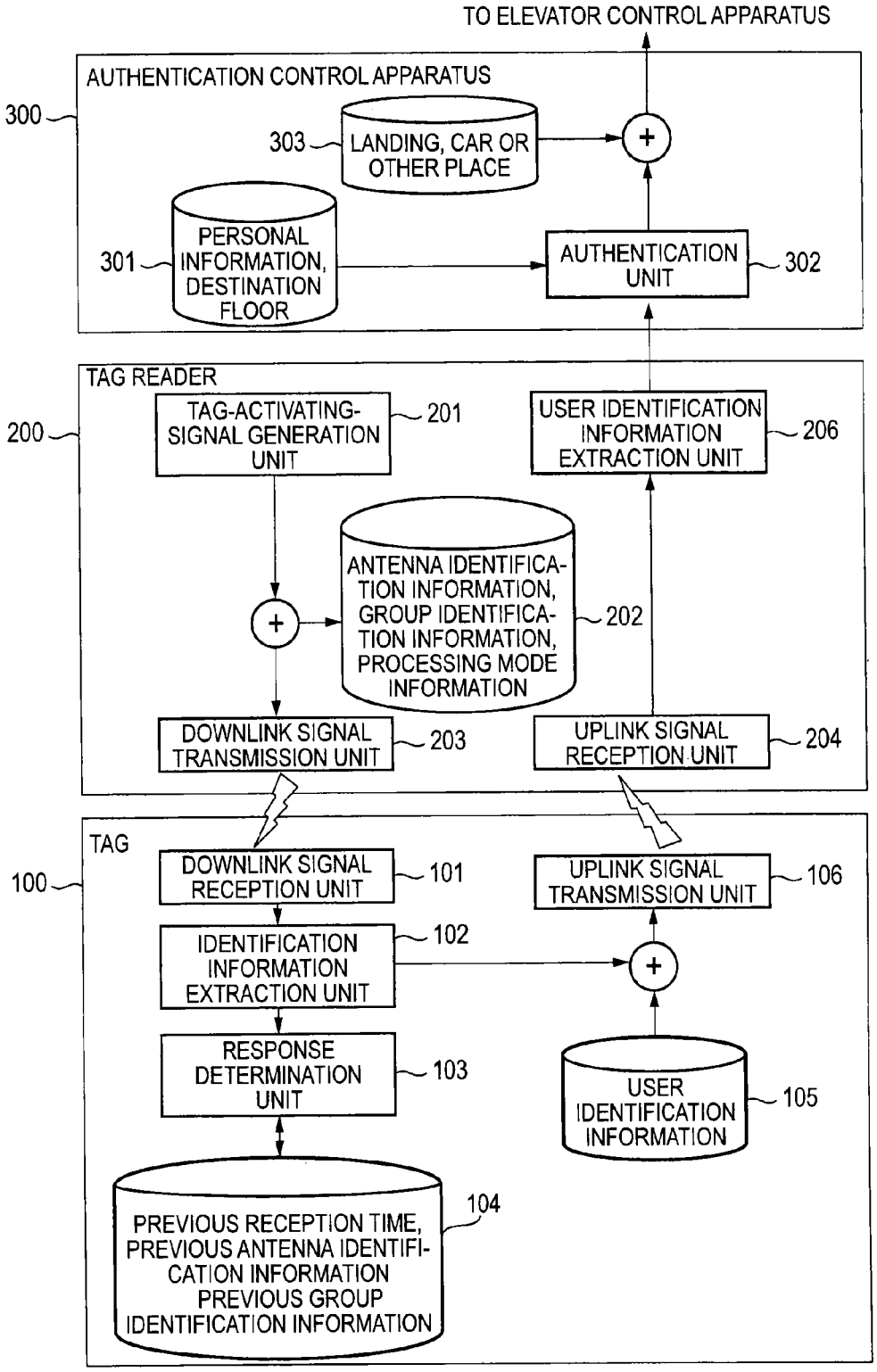
FIG. 6 is a flowchart showing operations of the tag 100 of the elevator call registering system according to a second illustrative embodiment of this disclosure.

In FIG. 6, a reference numeral 100 indicates a tag. The tag 100 is provided with a downlink signal reception unit 101 configured to receive a downlink signal from a tag reader, an identification information extraction unit 102 configured to extract antenna identification information and group identification information from the downlink signal, a response determination unit 103 configured to determine whether to transmit user identification information to the tag reader with an uplink signal, based on the antenna identification information, the group identification information, previous reception time, previous antenna identification information, previous group identification information and processing mode information, an uplink signal transmission unit 106 configured to transmit an uplink signal including the user identification information and the antenna identification information, a storage unit 104 configured to store therein the previous reception time, previous antenna identification information and the previous group identification information, and a storage unit 105 configured to store therein the user identification information. The downlink signal reception unit 101 includes a reception antenna circuit for receiving the downlink signal from the tag reader 200. The uplink signal transmission unit 106 includes a transmission antenna circuit for transmitting the uplink signal to the tag reader 200. A reference numeral 200 indicates a tag reader. The tag reader is provided with a tag-activating-signal generation unit 201 configured to generate a tag activating signal for activating the tag 100, a downlink signal transmission unit 203 configured to provide the antenna identification information, the group identification information and the processing mode information for the tag activating signal and to transmit the same as a downlink signal, an uplink signal reception unit 204 configured to receive the uplink signal from the tag 100, a user identification information extraction unit 206 configured to extract the user identification information included in the uplink signal, and a storage unit 202 configured to store therein the antenna identification information, the group identification information and the processing mode information. The downlink signal transmission unit 203 includes a transmission antenna circuit for transmitting the downlink signal to the tag 100. The uplink signal reception unit 204 includes a reception antenna circuit for receiving the uplink signal from the tag 100. A reference numeral 300 indicates an authentication control apparatus. The authentication control apparatus is provided with an authentication unit 302 configured to compare the user identification information transmitted from the tag reader 200 with stored personal information (the user identification information) and to transmit a destination floor associated with the user identification information to an elevator control apparatus when the information coincides with each other, and a storage unit 301 configured to associate and store therein the user identification information and a destination floor.

Hereinafter, the operations are described.

Figure 7:
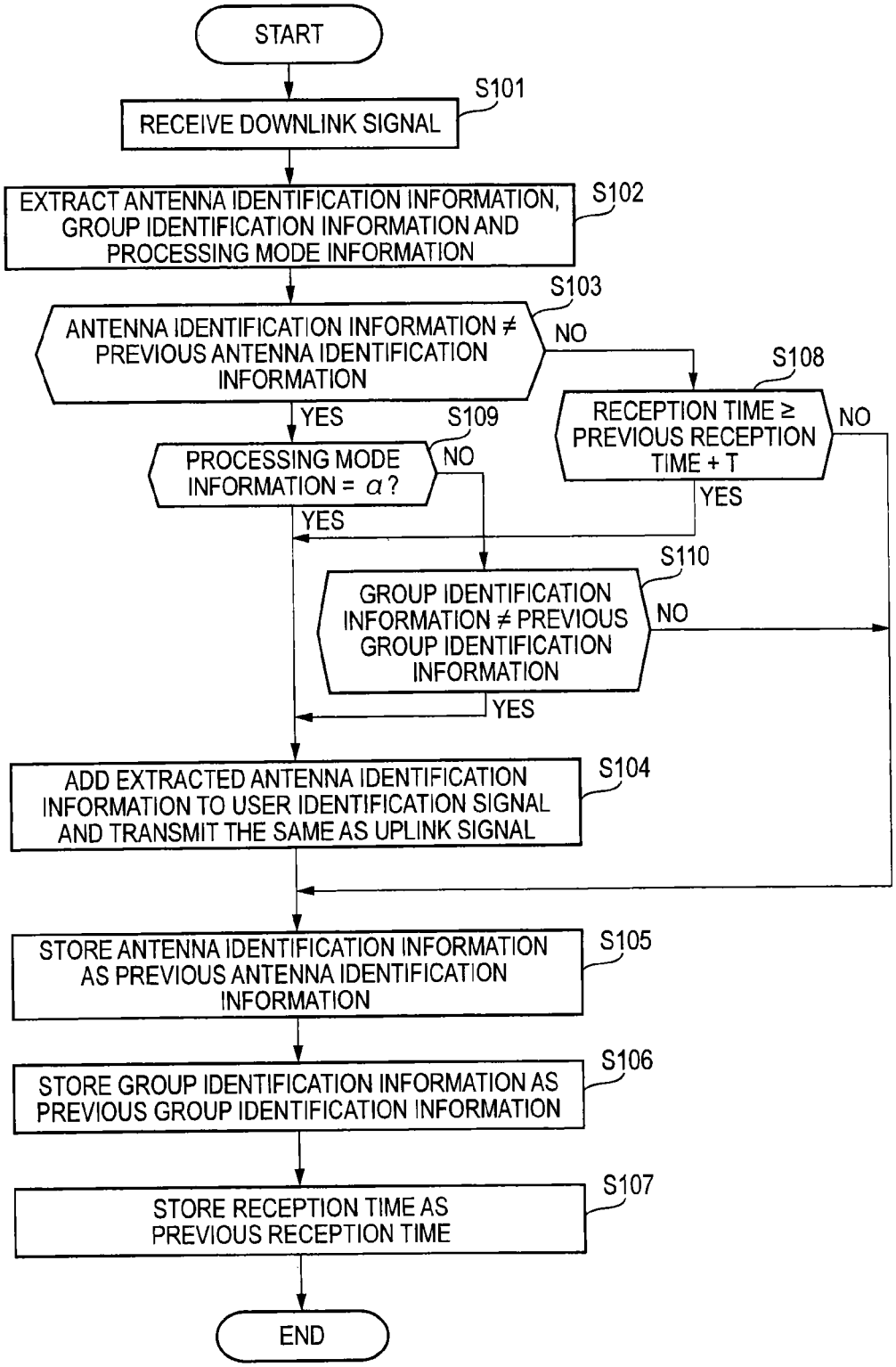
FIG. 7 is a flowchart showing operations of the tag reader 200 of the elevator call registering system according to the second illustrative embodiment of this disclosure.

FIG. 7 is a flowchart showing operations of the tag 100. When the downlink signal reception unit 101 receives a tag activating signal from the tag reader 200 (S101), the tag 100 extracts the antenna identification information, the group identification information and the processing mode information from the activating signal at the identification information extraction unit 102 (S102). The response determination unit 103 compares the extracted antenna identification information and the previous antenna identification information (the antenna identification information provided for the previous tag activating signal when the previous tag activating signal was received) stored in the storage unit 104 (S103). When the information does not coincide with each other, the response determination unit 103 determines that the activating signal is received from a tag reader different from the previous tag reader, and proceeds to S109. In S109, the tag proceeds to S104 or S110, depending on whether the extracted processing mode information is α or β. Here, the processing mode information α is a mode instructing the tag to unconditionally transmit the user identification information to the tag reader 200. The processing mode information β is a mode instructing the tag to determine whether or not to transmit the user identification information to the tag reader 200 based on the extracted group identification information and the stored previous group identification information. When the processing mode information is α in S109, the user identification information is unconditionally transmitted. Therefore, in order to transmit the user identification information to the tag reader 200 in S104, the tag reads out the user identification information from the storage unit 105, provides the read user identification information with the antenna identification information extracted in S102 and transmits the uplink signal from the uplink signal transmission unit 106. Thereafter, the tag rewrites the previous antenna identification information and previous group identification information in the storage unit 104 with the antenna identification information and group identification information of the activating signal received this time (S105, S106). At the same time, the tag 100 rewrites the previous reception time (time at which the previous tag activating signal was received) with this time reception time (S107)

On the other hand, when the processing mode information is β in S109, the tag compares the group identification information extracted in S102 and the previous group identification information stored in the storage unit 104 (S110). When the information does not coincide with each other, the tag proceeds to S104, reads out the user identification information from the storage unit 105 so as to transmit the user identification information to the tag reader 200, provides the read user identification information with the antenna identification information extracted in S102 and transmits the uplink signal from the uplink signal transmission unit 106.

On the other hand, when the antenna identification information and the previous antenna identification information coincide with each other in S103, the tag receives the activating signal from the same tag reader 200 as the previous tag reader and transmits the user identification information to the tag reader 200. Therefore, although it is not basically necessary to again transmit the user identification information, when the tag once deviates from a signal range of the tag reader 200 and again returns to the signal range of the tag reader 200 after predetermined time elapses, it is necessary to again transmit the user identification information for authentication. Hence, the response determination unit 103 compares the reception time of the tag activating signal and the previous reception time stored in the storage unit 104 and determines that the tag once deviates from the signal range of the antenna again returns to the signal range, when predetermined time T or longer elapses (S108), thereby preceding to S104, irrespective of the processing mode information. The reason is as follows. Considering the elevator landing, the tag holder approaches the elevator, so that the tag 100 is authenticated at the landing. However, if the tag holder leaves the landing without getting in the elevator and then again returns, the tag holder cannot get in the elevator without the authentication. Also, the reason to ignore the processing mode information is because even though the processing mode information of the tag reader 200 provided at the landing is β, the authentication is required when the tag holder once leaves the landing and then again returns.

Figure 8:
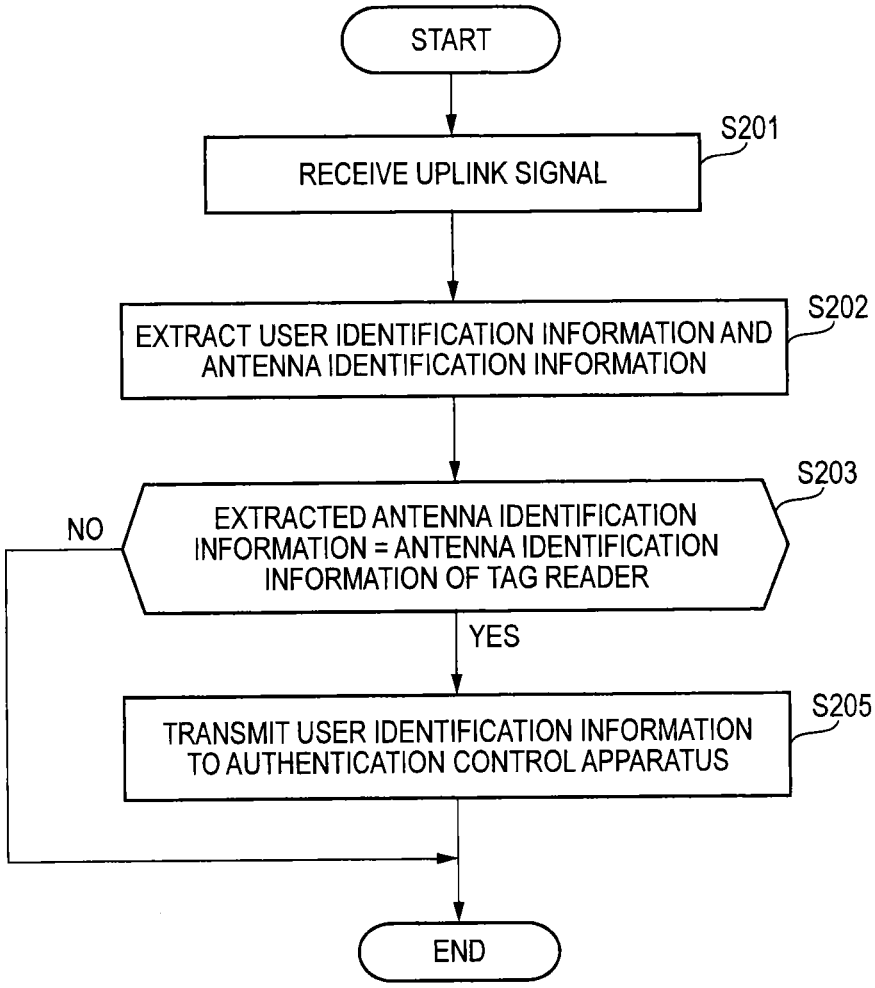
FIG. 8 is a configuration view where the elevator call registering system according to the second illustrative embodiment of this disclosure is applied to a building.

FIG. 8 is a flowchart showing operations of the tag reader 200. Although not in the flowchart, the tag reader 200 always generates the tag activating signal at the tag-activating-signal generation unit 201 at a predetermined interval, provides the generated tag activating signal with the antenna identification information, which is an inherent number to each tag reader and is stored in the storage unit 202, the group identification information for identifying some tag readers 200 as one group and the preset processing mode information and transmits the downlink signal from the downlink signal transmission unit 203.

When the tag reader 200 receives the uplink signal transmitted from the tag 100 at the uplink signal reception unit 204 (S201), the tag reader extracts the user identification information and antenna identification information from the received uplink signal at the user identification information extraction unit 206 (S202). Further, the tag reader 200 compares the antenna identification information thereof stored in the storage unit 202 with the extracted antenna identification information (S203). When the information coincides with each other, the tag reader determines that the tag 100 transmits the user identification information, in response to the tag activating signal transmitted from the tag reader, and executes subsequent processing. In S205, the tag reader 200 transmits the user identification information to the authentication control apparatus 300.

The authentication control apparatus 300 is provided with the storage unit 301. In the storage unit 301, the user identification information of a plurality of persons to be authenticated is beforehand registered with being associated with the destination floor (for example, a floor at which an office of a person is located) to which each person can go. When the user identification information is received from the tag reader 200, the authentication unit 302 searches the matched user identification information from the plurality of user identification information stored in the storage unit 301. When the matched user identification information is searched, the authentication control apparatus transmits the destination floor information associated with the matched user identification information to the elevator control apparatus, together with information capable of identifying whether the tag reader 200 is provided at the elevator landing, in the elevator car or at the other place.

Although the elevator control apparatus is not shown, when the destination floor information is received, the elevator control apparatus determines an upward or downward button provided at the elevator landing based on a relation between a current floor and the transmitted destination floor information, if the destination floor information is transmitted from the tag reader 200 provided at the elevator landing, and registers any one button (this is a state where the upward or downward button is pressed by a person).

When the destination floor information is transmitted from the tag reader 200*a* provided in the elevator car, the elevator control apparatus registers the transmitted destination floor (this is a state where a destination floor button is pressed by a person). When the destination floor information is transmitted from the other tag reader 200*c*, the elevator control apparatus ignores the destination floor information.

Figure 9:
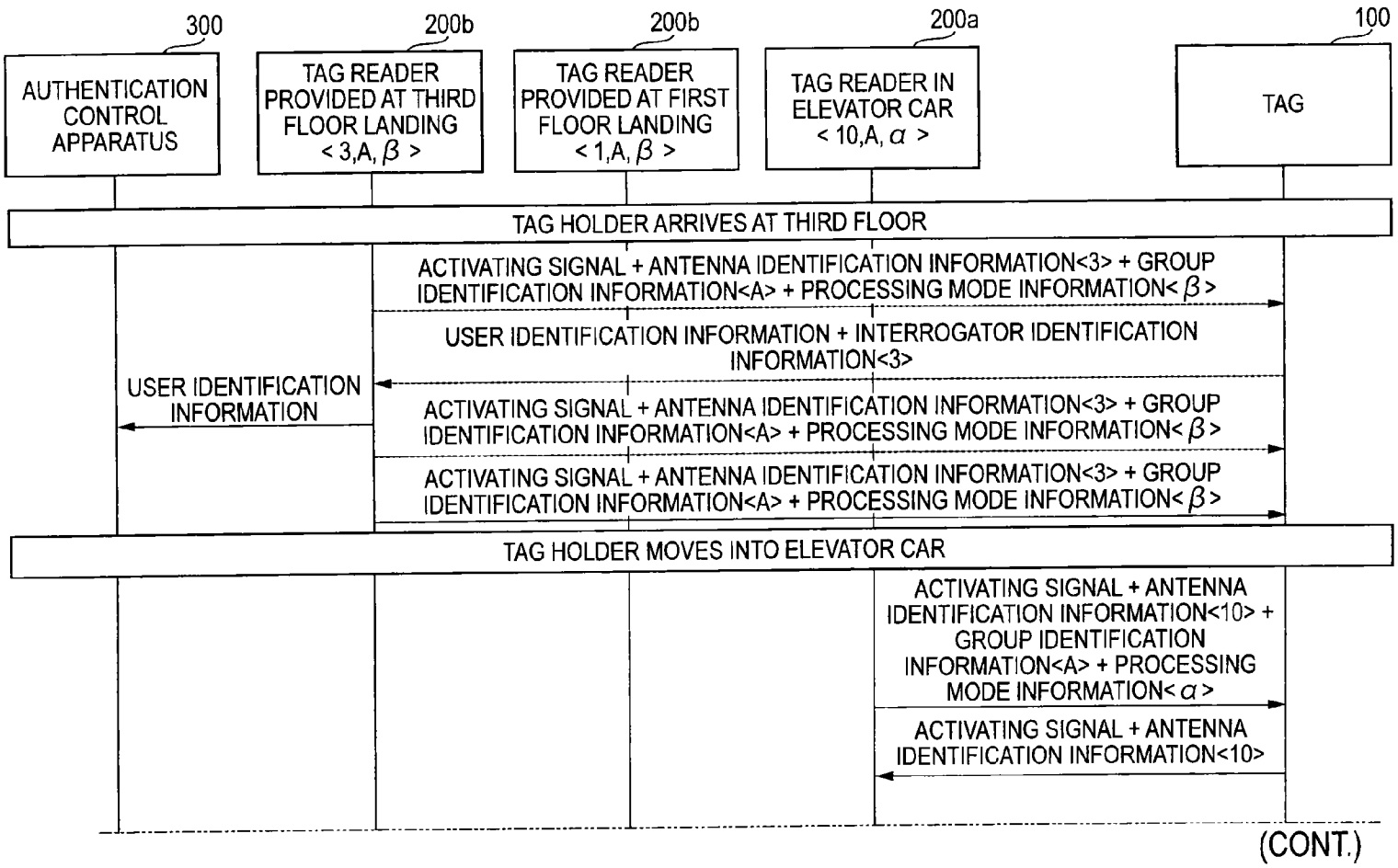
FIG. 9 is a flowchart showing respective identification information between respective apparatuses in the second illustrative embodiment of this disclosure.
Figure 9:
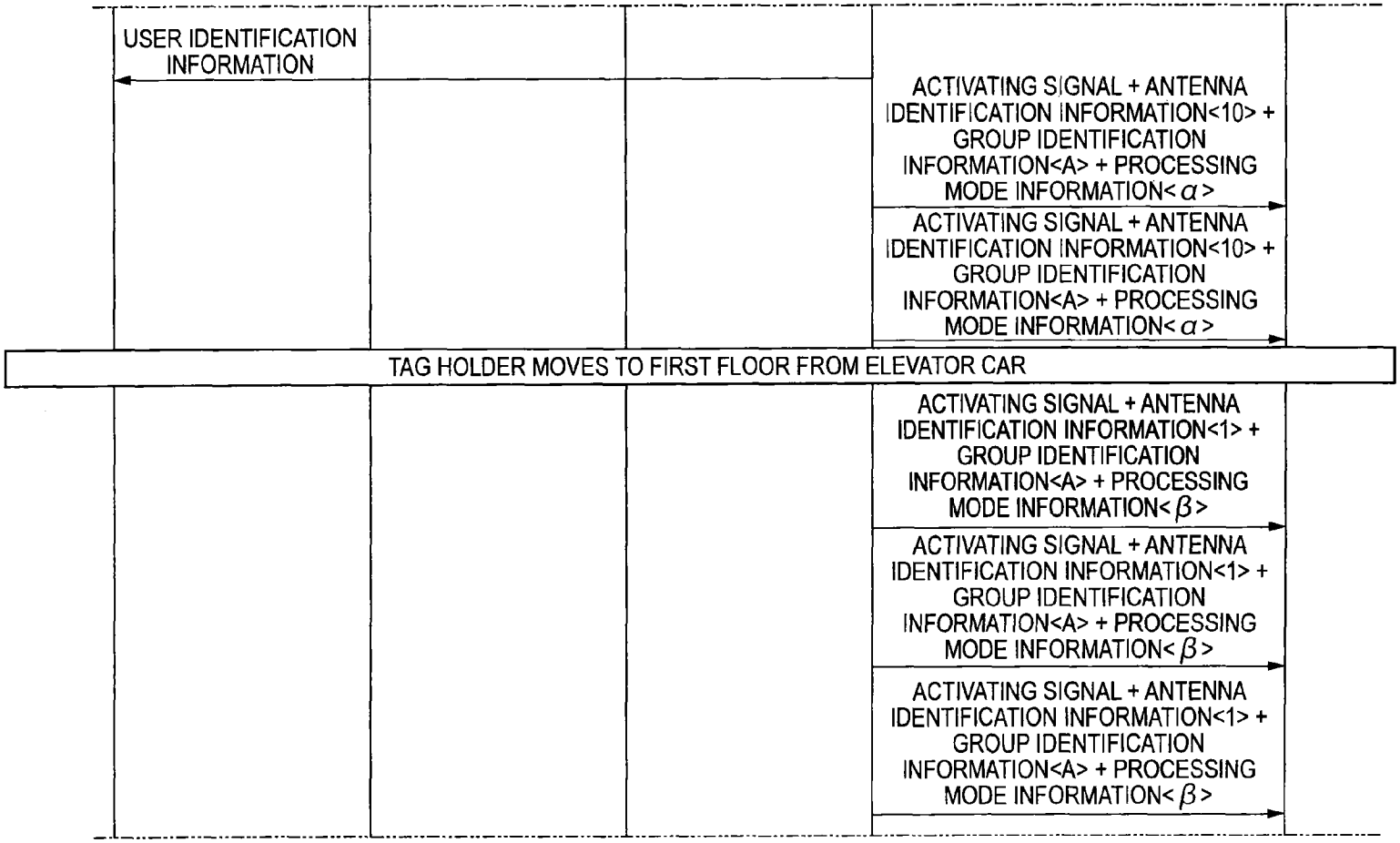
Figure 9:
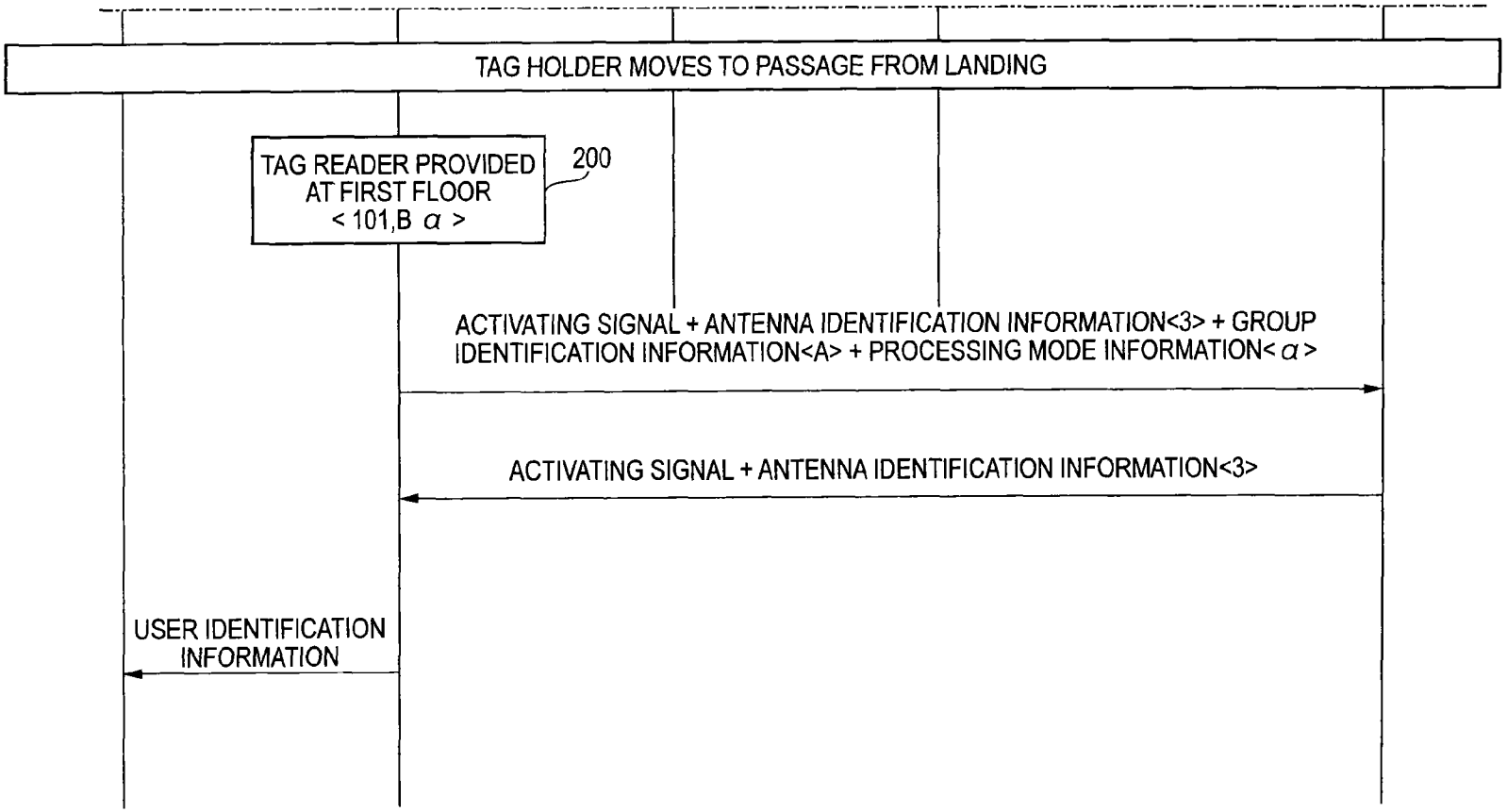

The above operations are described in association with moving with reference to FIGS. 4 and 9.

A case is described in which a tag holder passes to a third floor passage, arrives at the elevator landing, gets in the elevator to move to a first floor, gets off the elevator and passes to a first floor passage. It is assumed that the tag holder has beforehand registered the first floor, as the destination floor, in the authentication control apparatus 300.

In FIG. 4, for example, the description <103, D, α> indicates that 103 is set as the antenna identification information, D is set as the group identification information and α is set as the processing mode information in the tag reader 200.

First, the tag holder is authenticated at a stage where the tag holder enters the signal range of the tag reader 200*c* provided at the third floor. However, the elevator control apparatus ignores the destination floor information associated with the tag holder (which is not shown in FIG. 9). At a stage where the tag holder moves into the signal range of the tag reader 200*b* provided at the third floor landing, since the tag 100 is different from the previous antenna identification information (the antenna identification information 103 of the tag reader 200*c* provided at the third floor passage) storing as the tag 100 and is also different from the previous group identification information (the group identification information D of the tag reader 200*c* provided at the third floor passage) even though the processing mode information is β, the tag 100 transmits the user identification information to the tag reader 200*b*. The tag reader 200*b* transmits the received user identification information to the authentication control apparatus 300. When the authentication is successful, the authentication control apparatus 300 transmits the destination floor information (first floor) to the elevator control apparatus. As a result, since the current floor is the third floor and the destination floor information is the first floor, the elevator control apparatus registers the downward button. Therefore, even when the tag holder does not push the downward button, the elevator is automatically called. Until the elevator arrives, the tag 100 waits within the signal range of the tag reader 200*b* provided at the third floor landing and periodically receives the activating signal. However, since tag 100 has once transmitted the user identification information to the tag reader 200*b*, the tag 100 does not again transmit the user identification information as long as the tag stays within the signal range. Then, when the tag holder gets in the elevator having arrived and enters the signal range of the car tag reader 200*a*, since the tag 100 is different from the previous antenna identification information (the antenna identification information 3 of the tag reader 200*b* provided at the third floor landing) storing as the tag 100 and the processing mode information is α, the tag 100 unconditionally transmits the user identification information to the tag reader 200*a*. The tag reader 200*a* transmits the received user identification information to the authentication control apparatus 300. When the authentication is successful, the authentication control apparatus 300 transmits the destination floor information (first floor) to the elevator control apparatus. As a result, since the elevator control apparatus automatically registers the first floor button, the tag holder does not have to push the first floor button. When the elevator car arrives at the first floor and the tag holder gets off the elevator car and moves into the signal range of the tag reader 200*b* provided at the first floor landing, although the tag 100 is different from the previous antenna identification information (the antenna identification information 10 of the car tag reader 200*a*) storing as the tag 100, since the processing mode information is β and the previous group identification information (A of the car tag reader 200*a*) storing as the tag 100 coincides with the received group identification information (A of the tag reader 200*b* provided at the first floor landing), the tag 100 does not transmit the user identification information to the authentication control apparatus 300. As a result, since the authentication is not made when the tag holder moves from the elevator car to the tag reader 200*b* provided at the landing, the upward or downward button provided at the first floor landing is not registered.

Thereafter, when the tag holder moves into the signal range of the tag reader 200*c* provided at the first floor passage, since the tag 100 is different from the previous antenna identification information and the processing mode information is α, the tag 100 unconditionally transmits the user identification information. The tag reader 200*c* transmits the received user identification information to the authentication control apparatus 300. The authentication control apparatus 300 authenticates the user identification information and transmits the destination floor information to the elevator control apparatus. However, since the corresponding information is the information from the tag reader 200*c*, which is not provided at the elevator landing and in the elevator car, the elevator control apparatus ignores the information. Therefore, the elevator system does not work.

As described above, according to this illustrative embodiment, the tag transmits the user identification information to the tag reader to determine whether or not to authenticate the same. Therefore, when the tag holder arrives at the landing from the passage, the upward or downward button is automatically registered. Also, when the tag holder gets in the elevator car, the destination floor is automatically registered. However, when the tag holder gets off the elevator car and arrives at the landing, the unnecessary upward or downward button is not registered. Therefore, it is possible to prevent the problem that even when the user gets off the elevator, the call is registered.

In the above illustrative embodiment, the storage unit 104 and the storage unit 105 are separately provided. However, the same storage unit may be used with only the storage areas being separately provided. The storage unit 301 and the storage unit 303 are also the same.

Also, although the car tag reader 200*a*, the landing tag reader 200*b* and the passage tag reader 200*c* are described as separate configurations, they can be implemented with the same hardware inasmuch as they are configured to download the antenna identification information and group identification information of the storage unit 202 and the processing mode information of the storage unit 205 from the outside.

Further, the antenna identification information, the group identification information and the processing mode information of the above illustrative embodiment are just exemplary and can be variously changed or used without departing from the scope of this disclosure.

In addition, even when the parts of the configuration may be modified or omitted, the same effects as the illustrative embodiment can be realized.

Third Illustrative Embodiment

Figure 10:
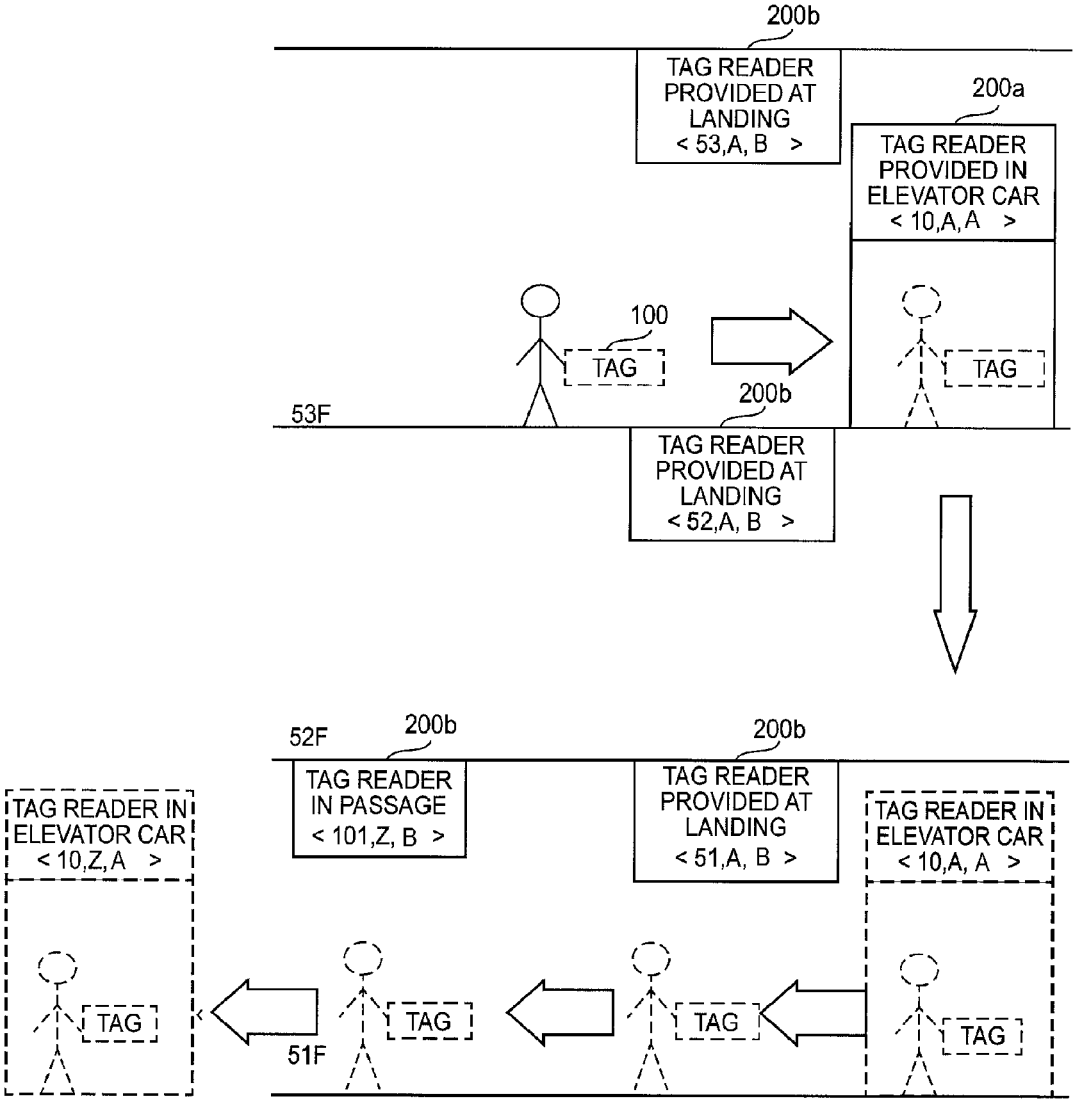
FIG. 10 is a configuration view of an elevator call registering system according to a third illustrative embodiment of this disclosure.

FIG. 10 shows an example where the tag holder moves down from a fifty-third floor to a fifty-first floor with the elevator and changes to another elevator at the fifty-first floor. In this case, the operations that are performed until the elevator is automatically called at the fifty-third floor, the tag holder gets in the elevator to move to the fifty-first floor and gets off the elevator at the fifty-first floor are the same as those of the moving from the third floor to the first floor. Thus, the descriptions thereof are omitted. When a tag holder moves to an elevator landing so as to change the elevator at a fifty-first floor, since the tag reader 200*c* has the antenna identification information 50, the group identification information Z and the processing mode information β and is different from the previous group identification information (A of the tag reader 200*c* provided at the just previous landing) even though the processing mode information is β, the authentication is made, so that the elevator is automatically called.

In the meantime, the above illustrative embodiments are just exemplary. For example, the above illustrative embodiments can be variously combined. These modified embodiments also can realize the same effects as this disclosure.

In addition, even when the parts of the configuration may be modified or omitted, the same effects as the illustrative embodiment can be realized.

This disclosure can be applied to an elevator call registering system using an RFID tag.

What is claimed is:

1. An elevator call registering system comprising:

a responder configured to be carried by an elevator user and to store therein user identification information;

an interrogator provided at an elevator landing of each floor, at a passage to the elevator landing and in an elevator car, respectively, and configured to broadcast interrogator identification information included in a downlink signal to the responder and to read out the user identification information from the responder; the responder being configured to compare the interrogator identification information received from the interrogator with stored interrogator identification information and to transmit the user identification information included in an uplink signal to the interrogator when a result of the comparison is not matched, an authentication control apparatus configured to compare the user identification information read out from the interrogator with stored user identification information and to transmit destination floor information of a user stored with being associated with the stored user identification information when a result of the comparison is matched, and an elevator control apparatus configured to allot an elevator car by using the destination floor information received from the authentication control apparatus, wherein the interrogator is configured to transmit group identification information included in the downlink signal, which can be set for each group, wherein the responder is configured to store therein the group identification information received from the interrogator and to transmit the user identification information and the stored group identification information to the interrogator included in the uplink signal based on a comparison result of the group identification information received from the interrogator and stored group identification information, wherein the interrogator further comprises a first determination unit configured to determine whether or not to transmit the user identification information to the authentication control apparatus based on a comparison result of the group identification information received from the responder and the group identification information of the interrogator when the user identification information is read out from the uplink signal, wherein the authentication control apparatus is configured to transmit the destination floor information to an elevator control apparatus, and wherein the interrogator provided at each elevator landing and the interrogator provided in the elevator car are grouped as a same group, and the interrogator provided at each passage is grouped as other groups different from the first group of the elevator landing and the elevator car.

2. The elevator call registering system according to claim 1, wherein the first determination unit of the interrogators provided in the elevator car and at each passage is configured to determine to unconditionally transmit the user identification information to the authentication control apparatus, and wherein the first determination unit of the interrogator provided at the elevator landing is configured to compare the group identification information received from the responder with own group identification information and to determine to transmit the destination floor information associated with the user identification information to the authentication control apparatus when the information does not coincide with each other.

3. An elevator call registering system comprising:

a responder configured to be carried by an elevator user and to store therein user identification information;

an interrogator provided at an elevator landing of each floor, at a passage to the elevator landing and in an elevator car, respectively, and configured to broadcast interrogator identification information included in a downlink signal to the responder and to read out the user identification information from the responder; the responder being configured to compare the interrogator identification information received from the interrogator with stored interrogator identification information and to transmit the user identification information included in an uplink signal to the interrogator when a result of the comparison is not matched, an authentication control apparatus configured to compare the user identification information read out from the interrogator with stored user identification information and to transmit destination floor information of a user stored with being associated with the stored user identification information when a result of the comparison is matched, and an elevator control apparatus configured to allot an elevator car by using the destination floor information received from the authentication control apparatus, wherein the interrogator is configured to transmit processing mode information, which indicates the responder on any one of at least two processing modes, and group identification information, which can be set for each group, included in the downlink signal, and wherein the responder is comprises: a second determination unit configured to store therein the group identification information received from the interrogator and configured to determine whether to unconditionally transmit the user identification information based on the processing mode information received from the interrogator or to transmit the user identification information and stored group identification information included in the uplink signal to the interrogator based on a comparison result of the group identification information received from the interrogator and the stored group identification information wherein the authentication control apparatus is configured to transmit the destination floor information to an elevator control apparatus, and wherein the interrogator provided at each elevator landing and the interrogator provided in the elevator car are grouped as a same group, and the interrogator provided at each passage is grouped as other groups different from the first group of the elevator landing and the elevator car.

4. The elevator call registering system according to claim 3, wherein the interrogator provided in the elevator car and the interrogator provided at each passage indicates a first processing mode, and the interrogator provided at each elevator landing indicates a second processing mode different from the first processing mode.

5. An interrogator provided at an elevator landing of each floor, a passage to the elevator landing and in an elevator car, respectively, and configured to transmit interrogator identification information, which is inherent to the interrogator, included in a downlink signal to a responder configured to be carried by an elevator user and to store therein inherent user identification information and to read out the user identification information from the responder to thus register an elevator call, the interrogator comprising:

a transmission unit configured to transmit group identification information, which can be set for each group, included in the downlink signal; and a first determination unit configured to determine whether or not to transmit the user identification information to an authentication control apparatus based on a comparison result of the group identification information received from the responder and group identification information of the interrogator when the user identification information is read out from uplink signal, wherein the authentication control apparatus is configured to transmit the destination floor information to an elevator control apparatus, and wherein the interrogator provided at each elevator landing and the interrogator provided in the elevator car are grouped as a same group, and the interrogator provided at each passage is grouped as other groups different from the first group of the elevator landing and the elevator car.

6. An interrogator that is provided at an elevator landing of each floor, a passage to the elevator landing and in an elevator car, respectively, and configured to transmit interrogator identification information, which is inherent to the interrogator, included in a downlink signal to a responder that is configured to be carried by an elevator user and to store therein inherent user identification information and to read out the user identification information from the responder to thus register an elevator call, the interrogator comprising:

a transmission unit configured to transmit processing mode information, which indicates the responder on any one of at least two processing modes, and group identification information, which can be set for each group, included in the downlink signal, and a first determination unit configured to determine whether or not to transmit the user identification information to an authentication control apparatus when the user identification information is read out from the uplink signal, wherein the authentication control apparatus is configured to transmit the destination floor information to an elevator control apparatus, and wherein the interrogator provided at each elevator landing and the interrogator provided in the elevator car are grouped as a same group, and the interrogator provided at each passage is grouped as other groups different from the first group of the elevator landing and the elevator car.

* * * * *